United States Patent [19]

Hogue

[11] 4,136,868

[45] Jan. 30, 1979

[54] EXERCISING SLANT BOARD

[76] Inventor: Charles J. Hogue, Box 449, Piedmont, Ala. 36272

[21] Appl. No.: 801,593

[22] Filed: May 31, 1977

[51] Int. Cl.[2] ..... A63B 23/02

[52] U.S. Cl. ..... 272/144; 5/116

[58] Field of Search ..... 272/144, 145, 134; 5/99 R, 99 B, 111, 114, 116

[56] References Cited

U.S. PATENT DOCUMENTS

| | | | |
|---|---|---|---|
| 1,300,872 | 4/1919 | Purcell | 5/114 |
| 1,624,965 | 4/1927 | Moore | 5/114 |
| 1,763,447 | 6/1930 | Schilling | 5/114 X |
| 2,658,754 | 11/1953 | Courtney | 272/145 |
| 2,724,592 | 11/1955 | Pfaus | 272/144 |
| 3,005,633 | 10/1961 | Riemer | 272/144 |
| 3,658,327 | 4/1972 | Thiede | 272/134 X |

OTHER PUBLICATIONS

"Strength and Health"; Sep. 1971; p. 76.

*Primary Examiner*—Richard J. Apley
*Attorney, Agent, or Firm*—Newton, Hopkins & Ormsby

[57] ABSTRACT

A slant board formed of panels which are selectively disposed in a common plane or folded back against each other. Longitudinally extending angle members pivotally connect the two panels together and also provide a hinge assembly with a transverse pivot axis, offset from the abutting edges of the panels, which limit pivoting movement so as to align the panels in a common plane. Adjustable legs are carried by one of the panels and a foot strap is provided for arresting the feet of a person utilizing the slant board. Transportation straps provide a handle for carrying the folded board.

10 Claims, 6 Drawing Figures

EXERCISING SLANT BOARD

BACKGROUND OF THE INVENTION

1. Field of the Invention

This invention relates to an exercising slant board and is more particularly concerned with a slant board which can be folded for ready transportation.

2. Description of the Prior Art

In the past, exercising slant boards have been produced and sold extensively in the United States. These slant boards are expensive devices which employ metal frames and hinge members which are quite complicated. For example, one of the slant boards produced in this country has approximately twenty-four (24) different parts and is complicated both to manufacture and to set-up.

SUMMARY OF THE INVENTION

Briefly described, the present invention includes a pair of panels which can be selectively disposed in a common plane or folded against each other into generally parallel planes. The two panels are connected together by longitudinally extending angle irons pivotally connected together along a transverse axis offset from the transverse line of abutment between the two panels when the panels are disposed in a common plane. The angle irons are cut so that they overlap to form the hinge and abut each other as the panels hinge into the common plane so as to prevent further movement of the panels beyond the common plane. Adjustable legs are carried by sleeves on a transversely extending bar, the sleeves being outwardly of the opposite sides of the panel.

Accordingly, it is the object of the present invention to provide an exercising slant board which is inexpensive to manufacture, durable in structure and efficient in operation.

Another object of the present invention is to provide an exercising slant board in which the legs thereof are readily and easily adjustable so as to change the inclination of the slant board.

Another object of the present invention is to provide an exercising slant board which has few parts and which can be easily and readily constructed with a minimum of labor and material.

Another object of the present invention is to provide an exercising slant board which is readily and easily set-up for operation and readily and easily knocked-down to a transportation position so that it can be carried from place to place.

Other objects, features and advantages of the present invention will become apparent from the following description when taken in conjunction with the accompanying drawings, wherein like characters of reference designate corresponding parts throughout the several views.

DESCRIPTION OF THE PREFERRED EMBODIMENT

Figure 1:
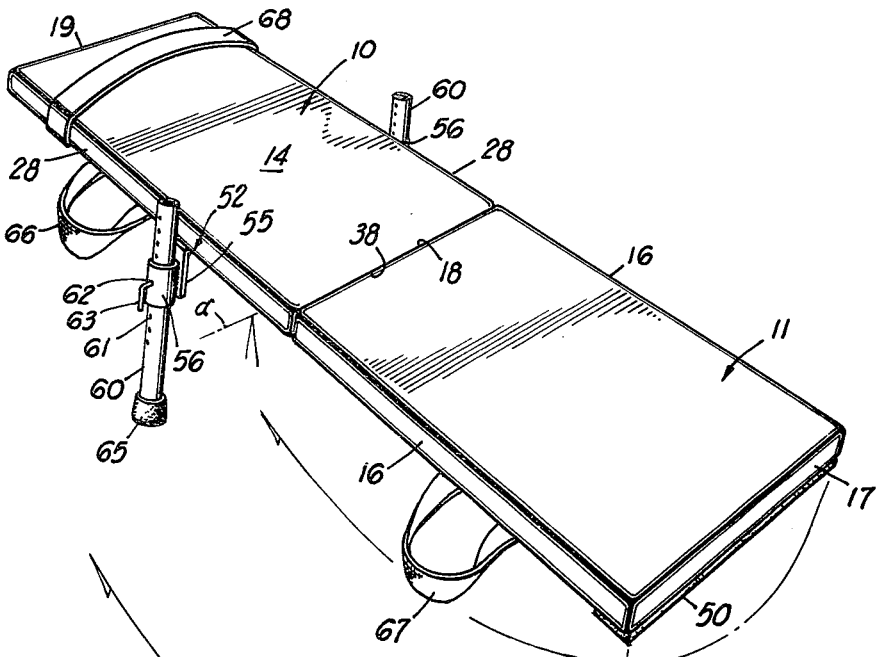
FIG. 1 is a perspective view of an exercising slant board constructed in accordance with the present invention, the slant board being disposed in a set-up condition.

Referring now in detail to the embodiment chosen for the purpose of illustrating the present invention, numeral 10 denotes generally the main or upper panel of the exercising slant board depicted in the drawings. Numeral 11 denotes the lower or smaller panel of the exercising slant board, the panels 10 and 11 each being rectangular and of approximately the same width. Thus, panel 10 has parallel longitudinally extending side edges 28, inner transverse or proximal edge 38 and outer transverse or proximal edge 19. In like fashion, panel 11 has side edges 16, transverse proximal edge 18 and transverse distal edge 17. The panel 10, however, is longer than the panel 11, as readily seen in FIG. 2.

Figure 5:
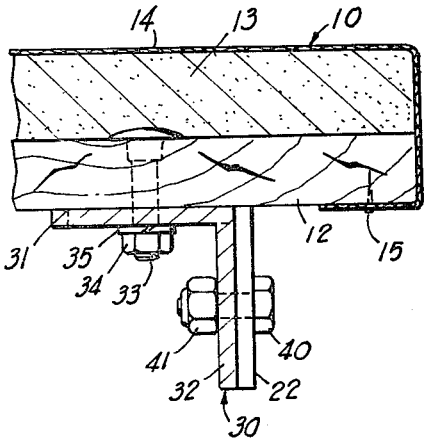
FIG. 5 is an enlarged vertical sectional view taken substantially along line 5—5 in FIG. 4.

Each panel 10 or 11 includes, as shown in FIG. 5, a flat rectangular, substantially rigid i.e., plywood or wooden base 12 and a flat rectangular resilient member 13, of the same size and shape, disposed on top of the board 12. The resilient member 13 is formed of any suitable resilient material such as a foamed plastic or the like. Disposed over the resilient member 13 is a cover 14 which is usually a vinyl plastic cover, the end portions of which are folded down around the common edges of the base 12 and the resilient material 13 and is tacked or stitched or otherwise affixed along the bottom portion of the base 12 by means of staples or nails 15.

Disposed along the bottom surface of the panel 10 are a pair of opposed, complementary, longitudinally extending, angle iron, struts 20 the struts 20 being disposed parallel to each other and parallel to the longitudinal edges 16 of the panel 11. Each of the struts 20 includes a horizontal flange 21 and a vertical flange 22 joined along a common edge. The flange 21 of each strut 20 is secured flat against the bottom surface of the wooden base of the panel 11, these struts 20 being secured in place by stove bolts 23 which extend through the wooden base of panel 11. Nuts 24 are threadedly carried by the ends of bolts 23 so as to secure the horizontal flanges 21 in place. The heads of each of the stove bolts 23 is concealed within the panel 11 between its wooden base and the resilient member thereof. The distal ends 25 of the struts 20 are curved and terminate inwardly of the transverse distal end 17 of panel 11, while the proximal ends of the struts 20 extend beyond the proximal or inner end or edge 18 of panel 11 so as to extend beneath a portion of the panel 10.

Figure 6:
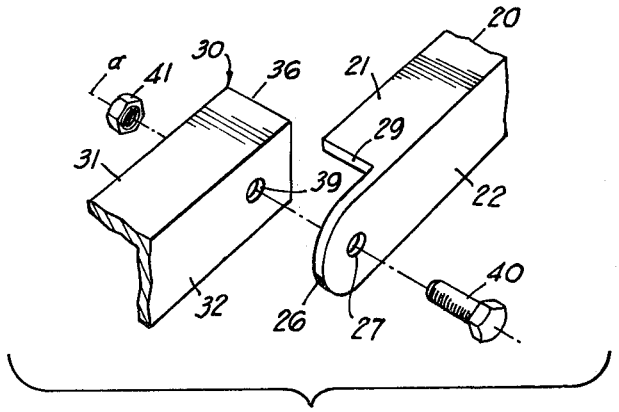
FIG. 6 is an enlarged exploded, perspective view of a detail showing one of the hinge assemblies of the slant board depicted in FIGS. 1-5.

As best seen in FIG. 6, the proximal end of strut 20 is notched and rounded so as to provide one element of a hinge assembly. In more detail, the flange 22 is provided with a rounded end portion 26 and a central hole 27 which is concentric with the curvature of the end 26. The flange 21 terminates in a transverse abutment shoulder 29, inwardly of the end 26.

For cooperating with the struts 20, the panel 10 is provided with a pair of opposed, complementary, spaced, parallel, longitudinally extending struts 30 which are respectively provided with horizontal flanges 31 and vertical flanges 32 disposed along common edges to provide angle irons. The horizontal flanges 31 are secured flat against the bottom surface of the wooden base 12 by means of stove bolts 33 provided with nuts 34 and washers, such as washer 35. The head of each stove bolt 33 is embedded in the panel 10 between the wooden base 12 and the resilient member 13. The vertical flange 32 of each strut 30 is disposed outwardly of the horizontal flange 31. The proximal end 36 of the strut 30 terminates inwardly of the proximal edge 38 of panel 10, being formed by a transverse cut. Adjacent to the proximal end 36, flange 32 is provided with a hole 39 which cooperates with hole 27 of strut 20 so that when the holes 27 and 29 are aligned, a pivot bolt 40 can be received therethrough to form a hinge member, the pivot bolt 40 being retained in place by a nut 41.

Figure 3:
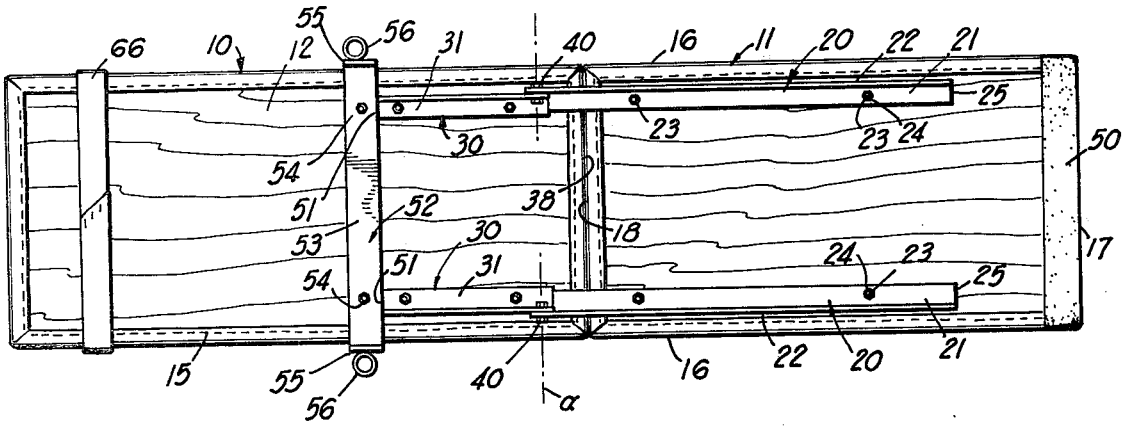
FIG. 3 is a bottom plan view of the exercising slant board as depicted in FIG. 1.

The bolts 40 are in transverse alignment as best seen in FIG. 3 so as to provide the hinge assembly with a pivot axis $\alpha$ which is offset, parallel to and below the abutting edges 18 and 38.

Figure 4:
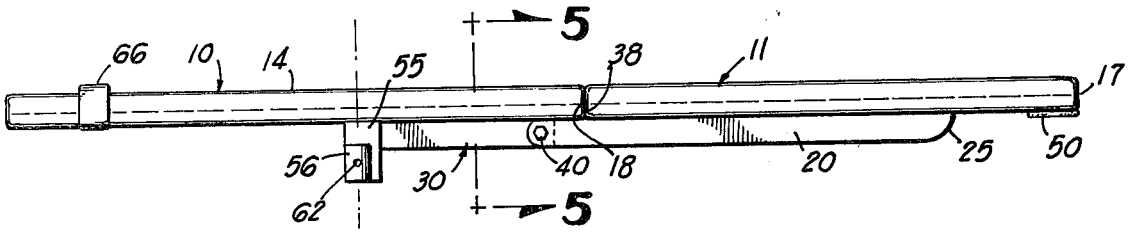
FIG. 4 is a side elevational view of the slant board depicted in FIG. 3.

The shoulder 29 of strut 20 is disposed so as to abut the end 36 when the struts 20 and 30 are in alignment with each other as depicted in FIGS. 3 and 4. Also, a portion of each flange 21 abuts the wooden material 12 of the panel 10 when the panels 10 and 11 are disposed in a common plane as shown in FIGS. 1, 3 and 4.

Figure 2:
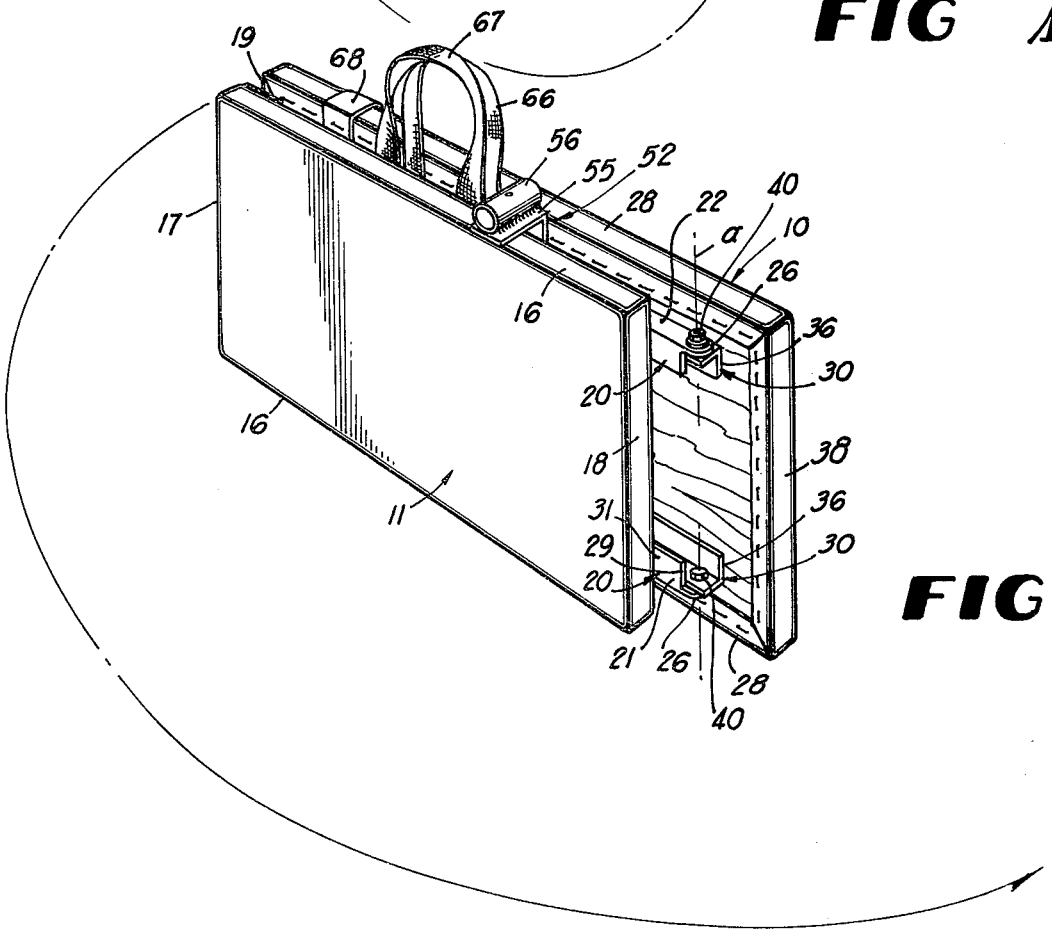
FIG. 2 is a perspective view of the slant board illustrated in FIG. 1, the slant board being in its folded or knocked-down condition, the legs being deleted from the drawing.

The panels 10 and 11, however, can be folded from their position in a common plane, in which the inner edges 18 and 38 abut to a position in which the panels 10 and 11 are disposed approximately parallel to each other as shown in FIG. 2. When the exercise board is in the folded, knocked-down or transportation position of FIG. 2, the vertical flanges 22 are disposed outwardly adjacent the vertical flanges 32.

Since the panels 10 and 11 are of the same widths, the side edges 18 of the panel 10 remain aligned with the side edges 16 respectively, regardless of whether the exercising slant board is in the coplanar or set-up position shown in FIG. 1 or the knocked-down position shown in FIG. 2. When the panel 11 is folded into juxtaposition with the panel 10, as shown in FIG. 2, the distal edges 17 and 19 of the respective panels are aligned along a common transverse plane.

At the outer end of the panel 11 is a resilient protective strip 50 which is secured along the bottom edge as shwon in FIGS. 3 and 4. This protective strip 50 protects the furniture and floor from any damage when the exercising board is resting on the floor.

The struts 30, as best seen in FIG. 3, terminate in about the central portion of the panel 10. Outwardly of their distal ends 51, a transverse U-shaped metal bar 52 is provided. This metal bar 52 has a central body portion 53 which is secured flush against the bottom of panel 10 by means of bolts 54. The legs or flanges 55 of the bar 52 protrude downwardly from the ends of the body 53 and receive, welded thereto, sleeves 56. The sleeves 56, in turn, removably and slideably receive straight cylindrical tubular legs 60 which are provided with axially aligned, evenly spaced holes 61. The holes 61 of each leg 60 are selectively alignable with a hole 62 in the sleeve 56 so as to receive a locking pin 63 therein. The locking pin 63 arrests the slideable movement of the leg 60.

The panel 11 is disposed between flanges 55 when it is in its juxtaposed position as shown in FIG. 2.

The legs 60 extend downwardly, generally perpendicularly to the panel 10 so that by manipulation of the legs the inclination of the aligned panels 10 and 11 can be varied as desired. The lower end of each leg 60 is provided with a rubber or resilient ferrule 65 which rest upon the ground.

Secured to the sides of the panels 10 and 11 are transportation straps 66 and 67 which are brought into general alignment when the panels 10 and 11 are folded to their juxtaposed position as shown in FIG. 2.

Outwardly of the legs 60, adjacent the distal end 19 of panel 10, a continuous strap 68 is provided which extends around the opposite sides 28 so as to provide a means by which the feet of a person can be arrested so that the person may do appropriate exercises while resting upon the exercising slant board.

It will be obvious to those skilled in the art that many variations may be made in the embodiment here chosen for the purpose of illustrating the present invention and that full result may be had to the doctrine of equivalence without departing from the scope of this invention as defined by the appended claims.

I claim:

1. An exercising slant board comprising a pair of rectangular substantially rigid panels; a hinge assembly securing said panels together, said panels having proximal transverse edges, said hinge assembly having a transverse hinge axis approximately parallel to said proximal edges below one of said panels, said axis being offset longitudinally from said proximal edges; said panels, in their set-up position, being in approximately a common plane with their proximal edges in abutting relationship, said panels being pivotable about said transverse axis to a folded position adjacent to each other; and leg means for supporting sand slant board.

2. The exercising slant board defined in claim 1 wherein each of said panels includes a flat wooden base and a flat resilient member disposed over said base, said base and said member each being of approximately the same dimensions and a cover extending over said flat resilient member, said cover being secured to the lower surface of said base, adjacent the edges thereof.

3. The exercising slant board defined in claim 1 including means for supporting legs disposed outwardly adjacent the edges of one of said panels and legs adjustably carried by said means.

4. The exercising slant board defined in claim 3 wherein said means includes a U-shaped bar, having a base which extends transversely across the bottom portion of one of said panels and is secured thereto, and flanges extending from the ends of said base parallel to each other on opposite sides of said panel, sleeves respectively secured to said flanges of said strap, said sleeves respectively slideably received said first mentioned legs and means for arresting the slideable movement of the first mentioned legs in said sleeves.

5. The exercising slant board defined in claim 1 wherein said hinge assembly includes a pair of opposed parallel first struts secured to the bottom surface of one of said panels and a pair of opposed parallel second struts secured to the bottom surface of the other of said panels, said struts overlapping each other below one of said panels and pivot means passing through the overlapped portions of the struts.

6. The exercising slant board defined in claim 5 wherein said struts are each angle irons and wherein said first struts are provided with abutment shoulders against which portions of the second strut abut when said panels are disposed in parallel relationship to each other.

7. The exercising slant board defined in claim 5 including leg receiving means secured to one of said panels and legs slideably received within said means, the other of said panels being foldable against one of said panels and being disposed within said leg receiving means, when so folded.

8. The exercising slant board defined in claim 5 wherein said struts are disposed adjacent to each other when said panels are folded.

9. The exercising slant board defined in claim 8 including a foot arresting strap extending across the end portion of one of said panels for receiving the feet of a person utilizing the exercising slant board.

10. The exercising slant board defined in claim 9 including a resilient bumper across the bottom edge of the other of said panels.

* * * * *